US012025324B2

(12) United States Patent
Kim et al.

(10) Patent No.: US 12,025,324 B2
(45) Date of Patent: Jul. 2, 2024

(54) OUTDOOR UNIT OF AIR CONDITIONER

(71) Applicant: LG ELECTRONICS INC., Seoul (KR)

(72) Inventors: Daehyoung Kim, Seoul (KR); Ilyoong Shin, Seoul (KR); Pilhyun Yoon, Seoul (KR); Jaehwa Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 903 days.

(21) Appl. No.: 16/979,403

(22) PCT Filed: Aug. 31, 2018

(86) PCT No.: PCT/KR2018/010135
§ 371 (c)(1),
(2) Date: Sep. 9, 2020

(87) PCT Pub. No.: WO2019/177214
PCT Pub. Date: Sep. 19, 2019

(65) Prior Publication Data

US 2021/0055008 A1 Feb. 25, 2021

(30) Foreign Application Priority Data

Mar. 12, 2018 (KR) ..... 10-2018-0028534

(51) Int. Cl.
*F24F 11/89* (2018.01)
*F24F 1/16* (2011.01)
(Continued)

(52) U.S. Cl.
CPC ..... *F24F 1/24* (2013.01); *F24F 1/16* (2013.01); *F24F 1/22* (2013.01); *F24F 1/56* (2013.01);
(Continued)

(58) Field of Classification Search
CPC ..... F24F 1/16; F24F 1/22; F24F 1/24; F24F 1/56; F24F 11/88; F24F 11/89; F24F 13/20; F24F 13/30; F24F 2013/207
See application file for complete search history.

(56) References Cited

U.S. PATENT DOCUMENTS

2009/0077988 A1 3/2009 Ishikawa et al.
2014/0131019 A1 5/2014 Kagawa et al.
(Continued)

FOREIGN PATENT DOCUMENTS

JP 2012-215305 11/2012
KR 10-2008-0094820 10/2008
(Continued)

OTHER PUBLICATIONS

International Search Report dated Dec. 13, 2018 issued in Application No. PCT/KR2018/010135.

*Primary Examiner* — Jonathan Bradford
(74) *Attorney, Agent, or Firm* — KED & Associates LLP

(57) ABSTRACT

An outdoor unit for an air conditioner may include a case, a controller disposed in the case, a coupling member configured to connect the case to the controller, and a cooling pipe coupled to one side of the controller so as to perform heat-exchange with the controller. The controller may include a first controller connected to the coupling member so as to be rotatably coupled to the case, and a second controller coupled to the cooling pipe so as to be fixedly installed inside of the case.

14 Claims, 7 Drawing Sheets

(51) Int. Cl.

| | |
|---|---|
| ***F24F 1/22*** | (2011.01) |
| ***F24F 1/24*** | (2011.01) |
| ***F24F 1/56*** | (2011.01) |
| ***F24F 11/88*** | (2018.01) |
| ***F24F 13/20*** | (2006.01) |
| ***F24F 13/30*** | (2006.01) |

(52) U.S. Cl.
CPC ..... *F24F 11/88* (2018.01); *F24F 11/89* (2018.01); *F24F 13/20* (2013.01); *F24F 13/30* (2013.01); *F24F 2013/207* (2013.01)

(56) References Cited

U.S. PATENT DOCUMENTS

| | | | | |
|---|---|---|---|---|
| 2016/0231008 | A1 | 8/2016 | Park et al. | |
| 2017/0118871 | A1* | 4/2017 | Choi ..... | H05K 7/20354 |

FOREIGN PATENT DOCUMENTS

| | | |
|---|---|---|
| KR | 10-2014-0015547 | 2/2014 |
| KR | 10-2015-0091616 | 8/2015 |
| KR | 10-2016-0084280 | 7/2016 |
| KR | 10-2016-0097699 | 8/2016 |

* cited by examiner

OUTDOOR UNIT OF AIR CONDITIONER

TECHNICAL FIELD

An outdoor unit of an air conditioner is disclosed herein.

BACKGROUND ART

Air conditioners are apparatuses that maintain air in a predetermined space to the most proper state according to use and purpose thereof. In general, such an air conditioner includes a compressor, a condenser, an expansion device, and evaporator. Thus, the air conditioner has a refrigeration cycle in which compression, condensation, expansion, and evaporation processes of a refrigerant are performed. Thus, the air conditioner may heat or cool the predetermined space.

The predetermined space may be variously provided according to a place at which the air conditioner is used. For example, when the air conditioner is disposed in a home or office, the predetermined space may be an indoor space of a house or building.

The air conditioner includes an indoor unit installed in the predetermined space and an outdoor unit installed outside the predetermined space and connected to the indoor unit. When the air conditioner performs a cooling operation, an outdoor heat-exchanger provided in the outdoor unit may serve as a condenser, and the indoor heat-exchanger provided in an indoor unit may serve as an evaporator. On the other hand, when the air conditioner performs a heating operation, the indoor heat-exchanger may serve as the condenser, and the outdoor heat-exchanger may serve as the evaporator.

The outdoor unit of the air conditioner includes a case defining an outer appearance thereof, an outdoor heat exchanger installed inside the case, a control box, and the like. As the control box is fixed and installed inside the case, there is a problem that causes inconvenience to a worker.

In relation to the outdoor unit of the air conditioner as described above, the present applicant has filed and published the following document.

DOCUMENT 1

1. Patent Publication Number: 10-2016-0084280 (Date of Publication: Jul. 13, 2016)

2. Title of The Invention: OUTDOOR UNIT OF AIR CONDITIONER

In the document 1, the control box is installed to be movable to the inside of the outdoor unit to facilitate convenience of the worker. However, such movement of the control box has a problem that a sufficient space required for work is not secured for the worker.

Also, in order to secure the movement of the control box, there is a problem that it is impossible to attach a cooling pipe for cooling to the control box. Thus, there is a problem in that it is difficult to use a refrigerant cooling method having better cooling efficiency in the control box.

DISCLOSURE OF THE INVENTION

Technical Problem

In order to solve these problems, an object of the present invention is to provide an outdoor unit of an air conditioner, which is provided with a control box of which at least a portion is installed to be rotatable to the outside of a case.

Particularly, in the control box, a portion at which a control member having a high heat generation amount is installed is coupled to a cooling pipe so as to be fixed inside the case, and the remaining portion is rotatably installed. Accordingly, an object of the present invention is to provide an outdoor unit of an air conditioner in consideration of both cooling efficiency of the control box and worker's work convenience.

Technical Solution

An outdoor unit of an air conditioner according to an embodiment includes a case, a control unit disposed in the case, a coupling member configured to connect the case to the control unit, and a cooling pipe coupled to one side of the control unit so as to be heat-exchanged with the control unit. The control unit includes a first control unit part connected to the coupling member so as to be rotatably coupled to the case, and a second control unit part coupled to the cooling pipe so as to be fixedly installed inside the case.

Particularly, the control unit may further include at least one first control member installed in the first control unit part, and at least one second control member installed in the second control unit part. An amount of heat generation of the second control member may be greater than that of the first control member.

An outdoor unit of an air conditioner according to an embodiment includes a case, a service panel and a front panel, which are disposed parallel to each other to define an outer appearance of a front surface of the case, first and second side panels configured to define both side surfaces of the case, a rear panel configured to define an outer appearance of a rear surface of the case, a suction hole defined in each of the front panel, the first and second side panels, and the rear panel, and an outdoor heat exchanger disposed inside the case, the outdoor heat exchanger including a plurality of heat exchange parts disposed to correspond to the suction holes. At least a portion of the control unit may be installed to be rotatable from the inside of the case to the outside of the case.

Advantageous Effects

According to embodiments, only a portion of the control box may be installed to be movable to the outside of the case to improve cooling efficiency of the control box through the refrigerant cooling method and improve workability of the worker. More particularly, a portion at which the control member having the high heat generation amount such as the inverter PCB is installed may fix the cooling pipe to the inside of the case to effectively cool the control member. In addition, the portion at which the control member having the relatively low heat generation amount is installed may be installed to be rotatable to the outside of the case by the worker to secure sufficient working space for effective working.

MODE FOR CARRYING OUT THE INVENTION

Figure 1:
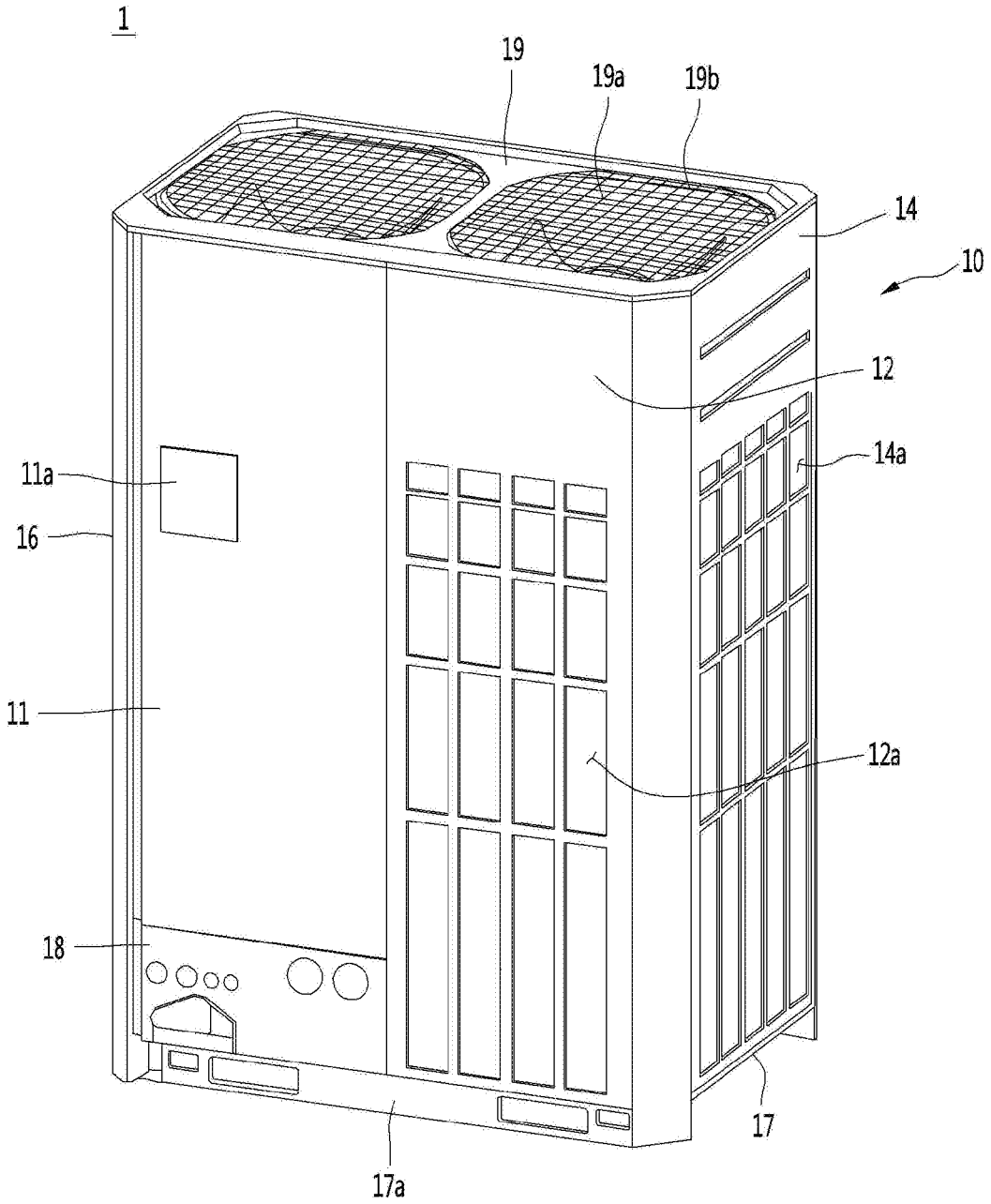
FIG. 1 is a view illustrating an outdoor unit of an air conditioner according to an embodiment.

Hereinafter, embodiments will be described with reference to the accompanying drawings. It is noted that the same or similar components in the drawings are designated by the same or similar reference numerals as far as possible even if they are shown in different drawings. In the following description, description of known functions and configurations incorporated herein will be omitted to avoid making the subject matter unclear.

In the description of the elements, the terms first, second, A, B, (a), and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
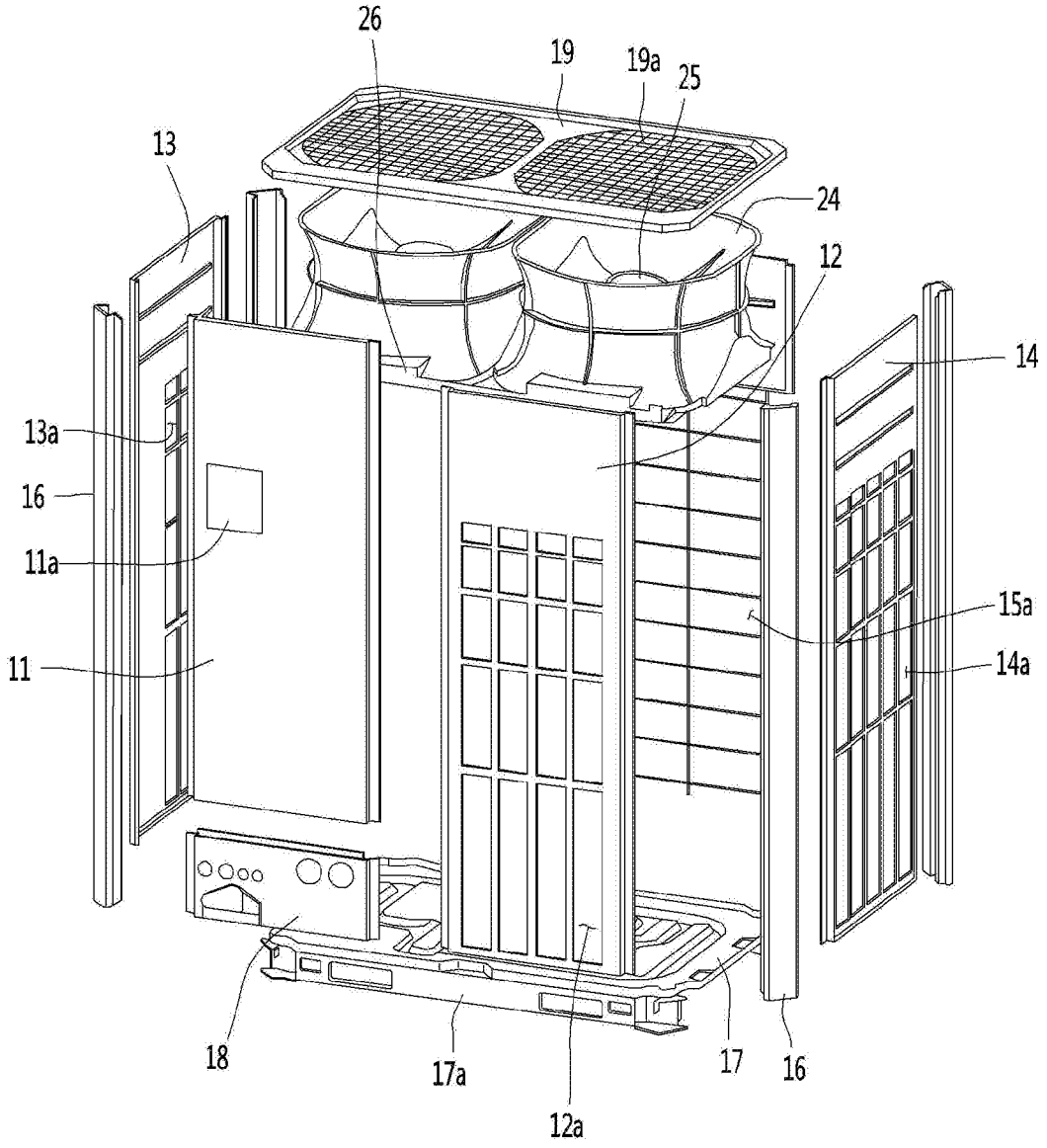
FIG. 2 is a view illustrating a state in which the outdoor unit of the air conditioner is separated according to an embodiment.

FIG. 1 is a view illustrating an outdoor unit of an air conditioner according to an embodiment. FIG. 2 is a view illustrating a state in which the outdoor unit of the air conditioner is separated according to an embodiment. FIGS. 1 and 2, for convenience of description, internal configurations, such as an outdoor heat exchanger, and a compressor, for example, and thus, their detailed shapes, are omitted.

As illustrated in FIGS. 1 and 2, an outdoor unit 1 of an air conditioner (hereinafter, referred to as an "outdoor unit") according to an embodiment includes a case 10 defining an outer appearance thereof. For example, the case 10 may be provided in the form of a box extending upward as a whole.

The case 10 includes a service panel 11 and a front panel 12, which defines an outer appearance of a front surface of the case 10, side panels 13 and 14 defining outer appearances of both side surfaces of the case 10, and a rear panel 15 defining an outer appearance of a rear surface of the case 10. The service panel 11 and the front panel 12 are disposed side by side with each other. Also, a pipe panel 18 is provided below the service panel 11. The pipe panel 18 may be configured so that a refrigerant pipe connecting the outdoor unit 1 to an indoor unit passes through the pipe panel 18 and is fixed to the pipe panel 18 and also may be understood as a portion of the service panel 11.

Hereinafter, a side panel adjacent to the service panel 11 is referred to as a "first side panel 13", and a side panel adjacent to the front panel 12 is referred to as a "second side panel 14".

The case 10 includes a base panel 17 defining a bottom surface thereof. The base panel 17 may be supported in a state of being spaced apart from a bottom surface by a base frame 17*a*. A compressor 21 and an outdoor heat exchanger 20 which constitute a refrigeration cycle may be disposed on a top surface of the base panel 17.

The case 10 includes a cover plate 19 defining the top surface thereof. Also, the case 10 includes a side supporter 16 defining an outer appearance of an edge of the case 10. The side supporter 16 extends vertically to connect the base panel 17 to the cover plate 19. That is, the side supporter 16 is coupled to each panel.

For example, the side supporter 16 is provided to connect the service panel 11 to the first side panel 13. Also, the side supporter 16 may be provided to connect the first side panel 13 to the rear panel 15, connect the second side panel 14 to the rear panel 15, and connect the second side panel 14 to the front panel 12.

As described above, the case 10 defines an outer appearance of the outdoor unit 1 by the service panel 11, the front panel 12, the first and second side panels 13 and 14, the rear panel 15, the base panel 17, the cover plate 19, and the side supporter 16. Suction holes 12*a*, 13*a*, 14*a*, and 15*a* are defined in the front panel 12, the first and second side panels 13 and 14, and the rear panel 15, and a discharge hole 19*a* is defined in the cover plate 19. That is, the outdoor unit 1 of the air conditioner according to embodiments is provided with a structure in which air is suctioned in a lateral direction and discharged upward. A discharge grill 19*b* is mounted on the discharge hole 19*a* to prevent external foreign substances from being introduced into the discharge hole 19*a*.

The outdoor unit 1 includes fan motor assemblies 24 and 25 installed at an inner upper portion of the case 10. Particularly, the fan motor assemblies 24 and 25 are installed on a mounting member 26 and fixed to the inner upper portion of the outdoor unit 1. The fan motor assembly includes a shroud 24, a blowing fan 25, and a motor (not shown), for example.

The shroud 24 may guide discharge of air. Thus, the shroud 24 may be vertically opened and have a side surface that is rounded in a shape of which a central portion is recessed inward. Also, the shroud 24 may have an opening that is gradually expanded upward from the central portion. The open top surface of the shroud 24 may have the same shape as the discharge hole 19*a* to effectively guide the discharge of air to the discharge hole 19*a*.

A plurality of the shroud 24 may be provided in the outdoor unit 1, and the blowing fan 25 may be disposed inside each of the shrouds 24. The air may forcibly flow according to driving of the blowing fan 25.

The suction holes 12*a*, 13*a*, 14*a*, and 15*a* may be defined below the shroud 24. That is, as illustrated in FIGS. 1 and 2, the suction holes are not defined at a top portion of the front panel 12, the first and second side panels 13 and 14, and the rear panel 15.

The suction holes 12*a*, 13*a*, 14*a*, and 15*a* are defined to correspond to the outdoor heat exchanger 20. Hereinafter, description will be made with reference to the internal configuration of the outdoor unit, which is illustrated in FIG. 3.

Figure 3:
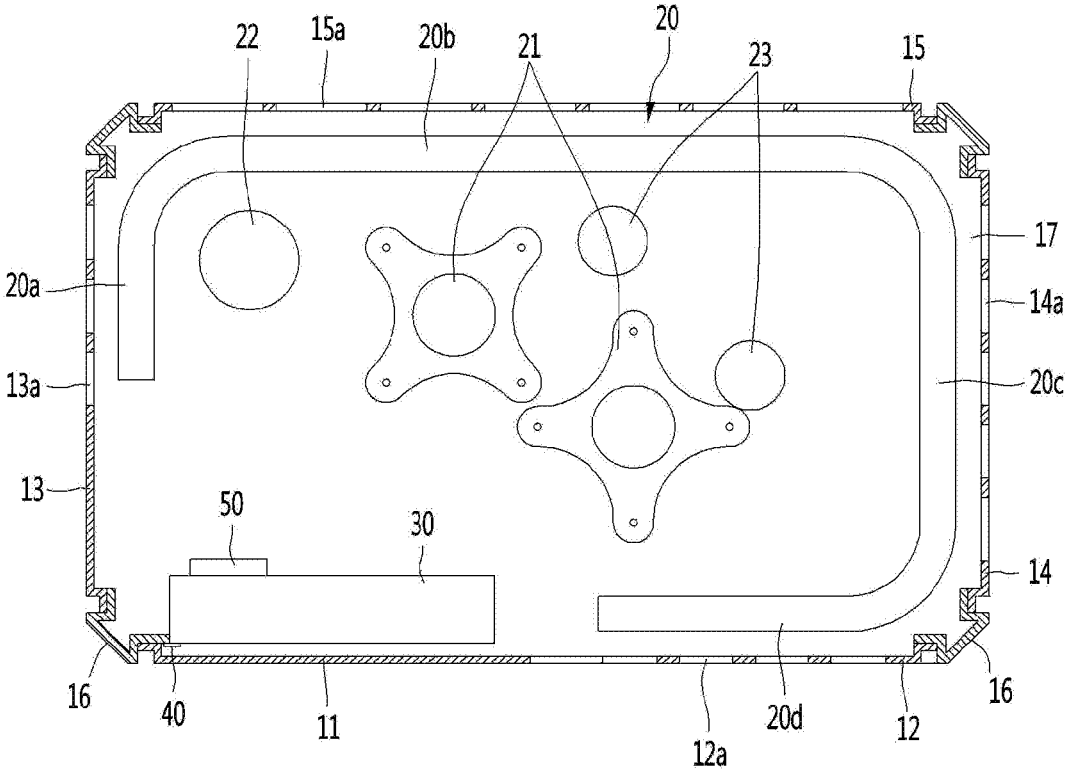
FIG. 3 is a view illustrating an internal configuration of the outdoor unit of the air conditioner according to an embodiment.

FIG. 3 is a view illustrating an internal configuration of the outdoor unit of the air conditioner according to an embodiment. FIG. 3 briefly illustrates an internal configuration of the outdoor unit and omits components, such as pipes and their detailed shapes.

As illustrated in FIG. 3, the outdoor unit 1 includes outdoor heat exchanger 20, compressor 21, an accumulator 22, and an oil separator 23, which are installed inside of the case 10. Also, the outdoor unit 1 according to embodiments includes a control unit or controller 30 that controls various components.

The outdoor heat exchanger 20 is provided to perform heat-exchange between the outdoor air and a refrigerant.

That is, indoor air may be heat-exchanged with the refrigerant while forcibly passing through the outdoor heat exchanger 20 by the blowing fan 25.

Also, the outdoor heat exchanger 20 extends vertically from the base panel 17 up to the mounting member 26 on which the fan motor assemblies 24 and 25 are installed. Also, the outdoor heat exchanger 20 is disposed along an inner circumference of the case 10.

The outdoor heat exchanger 20 includes a plurality of heat exchangers that are bent. For example, the outdoor heat exchanger 20 includes a first heat exchange part or heat exchanger 20*a* disposed inside of the first side panel 13, a second heat exchange part or heat exchanger 20*b* disposed inside of the rear panel 15, a third heat exchange part or heat exchanger 20*c* disposed inside of the second side panel 14, and a fourth heat exchange part or heat exchanger 20*d* disposed inside of the front panel 12.

The suction holes 12*a*, 13*a*, 14*a*, and 15*a* are defined to correspond, respectively, to each of the heat exchange parts 20*a*, 20*b*, 20*c*, and 20*d*. That is, the suction holes include first suction hole 13*a* defined in the first side panel 13 to correspond to the first heat exchange part 20*a*, second suction hole 15*a* defined in the rear panel 15 to correspond to the second heat exchange part 20*b*, third suction hole 14*a* defined in the second side panel 14 to correspond to the third heat exchange part 20*c*, and fourth suction hole 12*a* defined in the front panel to correspond to the fourth heat exchange part 20*d*.

As illustrated in FIG. 3, the outdoor heat exchanger 20 may be disposed in a state in which some areas are excluded around the inner circumference of the case 10. In detail, the outdoor heat exchanger 20 is not disposed on or at a rear side of the service panel 11 and a portion of a rear side of the first side panel 13.

The control unit 30 may be installed in a space in which the outdoor heat exchanger 20 is not disposed. In detail, the control unit 30 is installed at a front left or first side within the case 10 in the drawings. Also, the outdoor heat exchanger 20 is disposed to be bent from the first heat exchange part 20*a* disposed at a left or first rear portion of the control unit 30 to the fourth heat exchange part 20*d* disposed at a right or second front portion of the control unit 30.

That is, the control unit 30 is installed behind the service panel 11. This is to facilitate accessibility because the control unit 30 is frequently checked. Also, the service panel 11 may be provided with a service door 11*a* through which a worker may easily access the control unit 30 without separating the service panel 11. Various components, such as the compressor 21, the accumulator 22, and the oil separator 23 are disposed inside of the outdoor heat exchanger 20 and the control unit 30.

The compressor 21 may compress the refrigerant having a gaseous state at a high-temperature high-pressure. The compressor 21 may include a constant speed compressor that rotates at a constant speed to compress the refrigerant to a predetermined capacity and an inverter compressor that is variable in rotation speed according to a load to adjust a compressing capacity. That is, a plurality of compressors 21 may be provided as illustrated in FIG. 3.

The accumulator 22 is installed at an inlet side of the compressor 21 to separate an introduced liquid refrigerant and a gaseous refrigerant so as to supply the gaseous refrigerant to the compressor 21. The oil separator 23 is installed at an outlet side of the compressor 21 to separate oil contained in the refrigerant discharged from the compressor 21. Also, the refrigerant passing through the oil separator 23 may flow toward the indoor unit or the outdoor heat exchanger 20 according to an operation mode.

As described above, as the compressor 21, the accumulator 22, and the oil separator 23 are disposed inside of the outdoor heat exchanger 20 and the control unit 30, accessibility of the worker is not good. That is, maintenance and replacement of various components are very inconvenient due to the outdoor heat exchanger 20 and the control unit 30.

Thus, at least a portion of the control unit 30 of the outdoor unit 1 according to embodiments is rotatably installed. In detail, a portion of the control unit 30 may rotate to the outside of the case 11 so that the worker secures a sufficient working space. Hereinafter, this will be described in detail.

Figure 4:
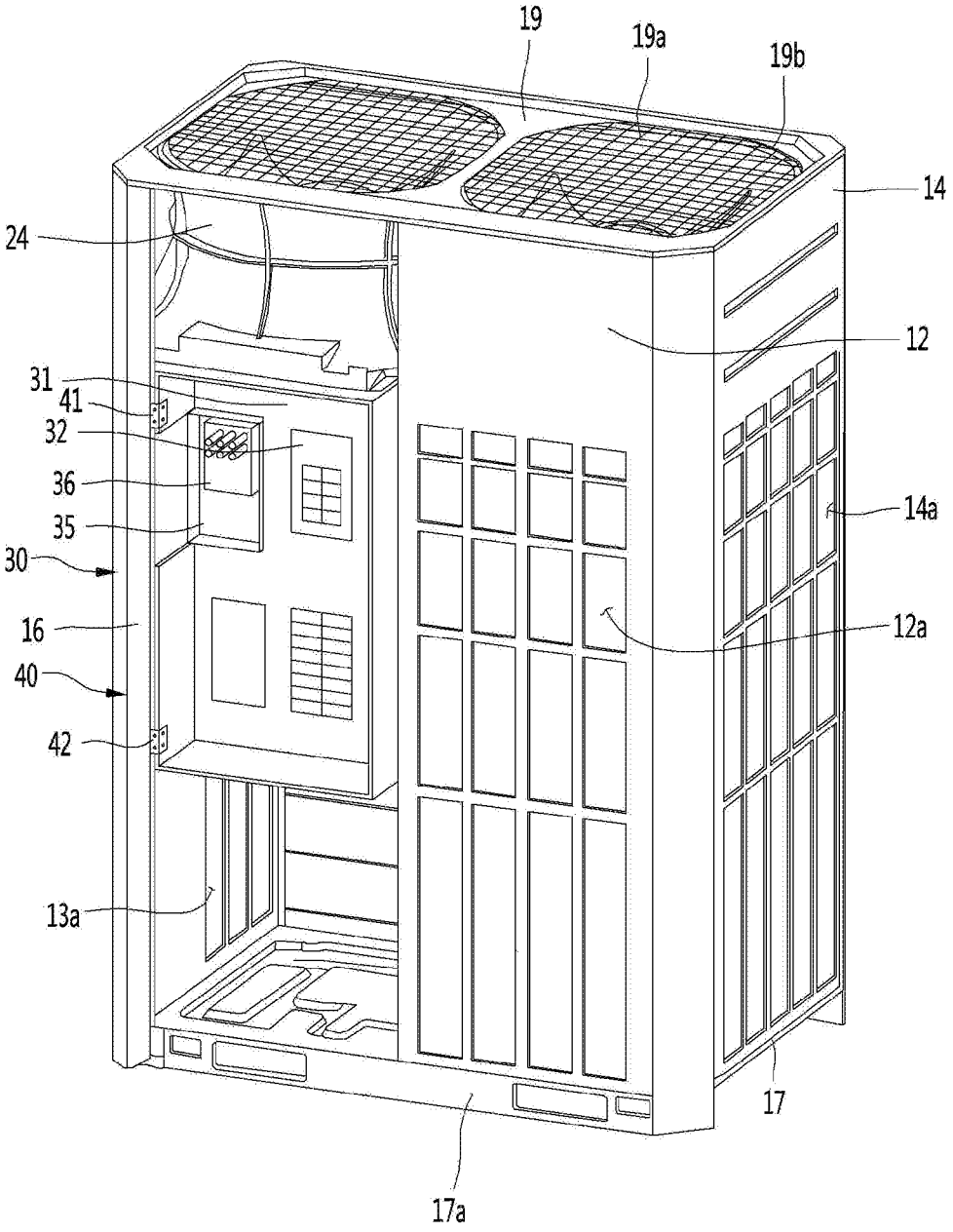
FIG. 4 is a view illustrating a first arrangement of the outdoor unit of the air conditioner according to an embodiment.
Figure 5:
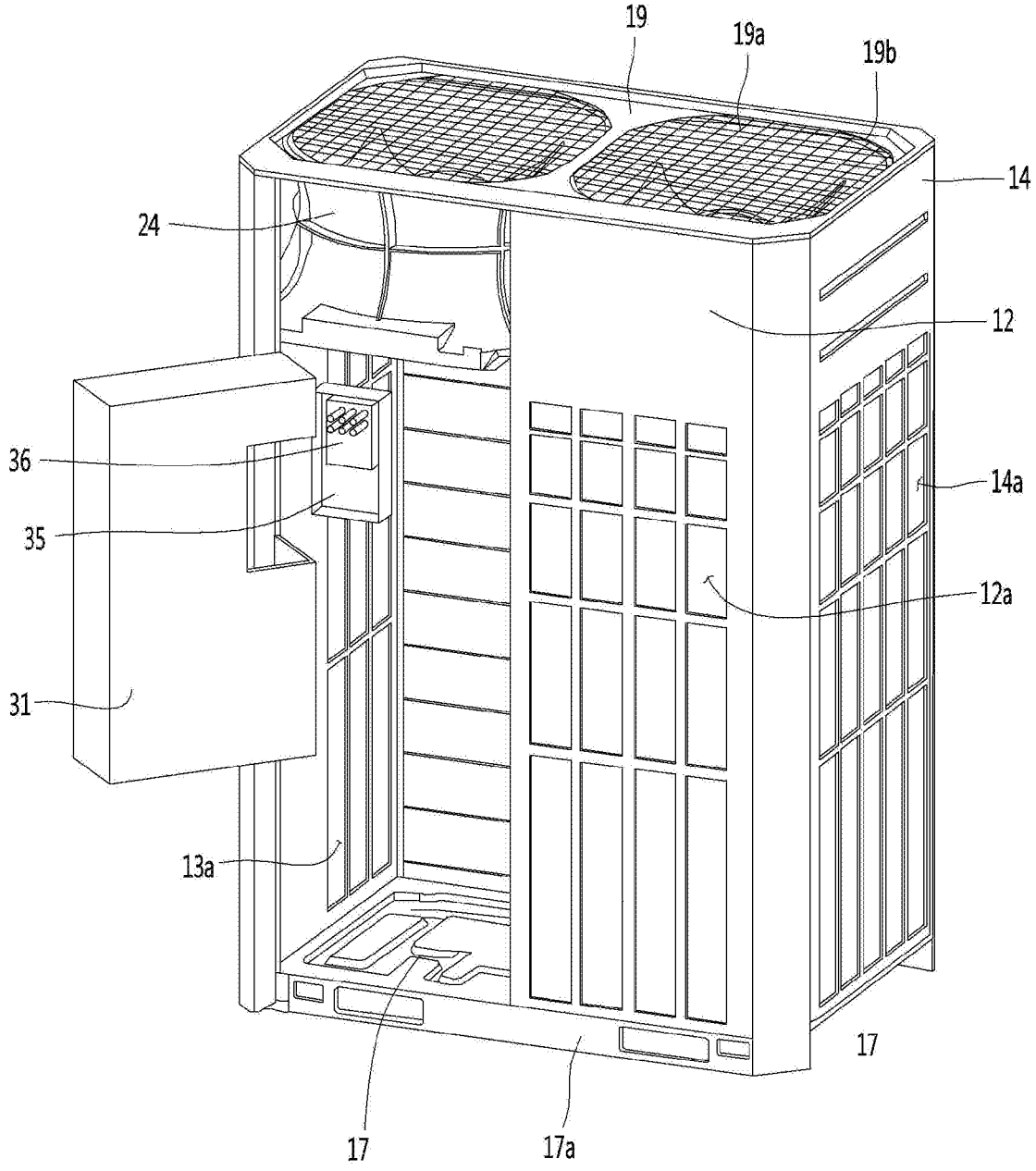
FIG. 5 is a view illustrating a second arrangement of the outdoor unit of the air conditioner according to an embodiment.

FIG. 4 is a view illustrating a first arrangement of the outdoor unit of the air conditioner according to an embodiment. FIG. 5 is a view illustrating a second arrangement of the outdoor unit of the air conditioner according to an embodiment.

FIGS. 4 and 5 are views illustrating a state in which the service panel 11 including the pipe panel 18 in FIG. 1 is separated. That is, the service panel 11 is configured to be independently detachable while front panel 12 and the other panels are mounted, as a "service surface". Thus, a worker may start work by detaching the service panel 11 as illustrated in FIG. 4.

As described above, the control unit 30 is disposed at a rear side of the service panel 11. Thus, as illustrated in FIG. 4, when the service panel 11 is separated, the control unit 30 is exposed to the outside.

Accessibility to the inner space of the case 10 is very low due to the control unit 30. Referring to FIG. 4, the worker may access the compressor 21, for example, only through a lower space of the control unit 30. Thus, an operation of checking components installed inside of the case 10 may not be easily performed.

To solve this, at least a portion of the control unit 30 of the outdoor unit 1 according to embodiments is provided to be rotatable. In detail, the control unit 30 includes a first control unit part or controller 31 rotatably coupled to the case 10 and a second control unit part or controller 35 fixed to the inside of the case 10.

Also, the control unit 30 further include at least one first control member 32 installed in the first control unit part 31 and at least one second control member 36 installed in the second control unit part 35. That is, all the first control unit part 31 and the second control unit part 35 correspond to portions of the control unit 30, in which various devices are installed.

A heat generation amount of the second control member 36 is higher than a heat generation amount of the first control member 32. That is, the first control unit part 31 is provided with devices having a relatively low heat generation amount. Thus, the first control unit part 31 may be understood as a portion at which cooling is not required. For example, the first control member 32 may include a main PCB, an external PCB, a terminal block, a noise filter, and a reactor.

The second control unit part 35 is provided with devices having a relatively high heat generation amount. Thus, the second control unit part 35 may be understood as a portion for which cooling is required.

For example, the second control member 36 may include an inverter PCB. The inverter PCB corresponds to a high temperature generation portion for which cooling has to be performed. As a heat generation amount of the inverter PCB increases as a capacity of the outdoor unit 1 increases, a refrigerant cooling method having good cooling efficiency is required.

As a result, the outdoor unit 1 includes a cooling unit 50 (see FIG. 7) coupled to the second control unit part 35 so as to perform heat-exchange with the second control member 36. The cooling unit 50 includes a cooling pipe 52 coupled to one side of the control unit 30 so as to perform heat-exchange with the second control member 36 through the refrigerant cooling method.

In summary, the control unit 30 is provided to be separable into a portion at which cooling is required and a portion at which cooling is not required. The cooling pipe 52 may be coupled to the portion at which cooling is required so as to be effectively cooled, and the portion at which cooling is not required may be rotatably provided to secure the working space.

A case in which the first control unit part 31 is disposed inside of the case 10 is referred to as a "first position" of the first control unit part 31. A case in which the first control unit part 31 is disposed outside of the case 10 is referred to as a "second position" of the first control unit part 31.

It may be understood that the first control unit part 31 is disposed at the first position in FIG. 4, and the first control unit part 31 is disposed at the second position in FIG. 5. Also, as illustrated in FIG. 4, the state in which the control unit 30 is disposed inside of the case 10 is referred to as a "first arrangement of the outdoor unit" or "first arrangement of the control unit". Also, as illustrated in FIG. 5, the state in which the control unit part 31 is disposed inside of the case 10 is referred to as a "second arrangement of the outdoor unit" or "second arrangement of the control unit".

Generally, the outdoor unit 1 is provided as the first arrangement of the control unit 30 as illustrated in FIG. 4 and is provided as the second arrangement of the control unit 30 as illustrated in FIG. 5 only during operation. That is, the first control unit part 31 is generally provided at the first position and is provided at the second position only in a special case.

Also, the outdoor unit 1 includes a coupling member 40 that connects the case 10 to the control unit 30. The coupling member 40 connects the first control unit part 31 to the case 10. In detail, the coupling member 40 connects the first control unit part 31 to the side supporter 16 connecting the service panel 11 to the first side panel 13.

Thus, the first control unit part 31 is rotatably coupled to the side supporter 16 by the coupling member 40. More particularly, the first control unit part 31 is rotatably installed from the inside of the case 10 to the outside of the case 10.

The coupling member 40 may include at least one hinge 41 and 42 installed in the case 10. The hinges 41 and 42 are coupled to the first control unit part 31 and the side supporter 16 so that the first control unit part 31 is rotatable about the side supporter 16.

The first control unit part 31 may rotate at or to various rotational angles according to the hinges 41 and 42. The rotational angle of the first control unit part 31 illustrated in FIG. 5 is merely an example and thus is not limited thereto.

The second control unit part 35 is coupled to the cooling unit 50 and is fixed and installed inside of the case 10. That is, the second control unit part 35 is disposed to be fixed at a position corresponding to a rear side of the service panel 11. Thus, when the first control unit part 31 is disposed at the first position, the first control unit part 31 and the second control unit part 35 are disposed to contact each other.

Also, the second control unit part 35 is disposed so that the side supporter 16 contacts one side thereof. This arrangement is to secure the working space as much as possible by locating the second control unit part 35 at one side when the first control unit part 31 is disposed at the second position, as illustrated in FIG. 5.

The first control unit part 31 is connected to the side supporter 16 to surround the second control unit part 35. That is, the first control unit part 31 may be disposed closer to the front panel 12 than the second control unit part 35. Also, the coupling member 40 includes first hinge 41 disposed above the second control unit part 36 and second hinge 42 disposed below the second control unit part 35.

Figure 6:
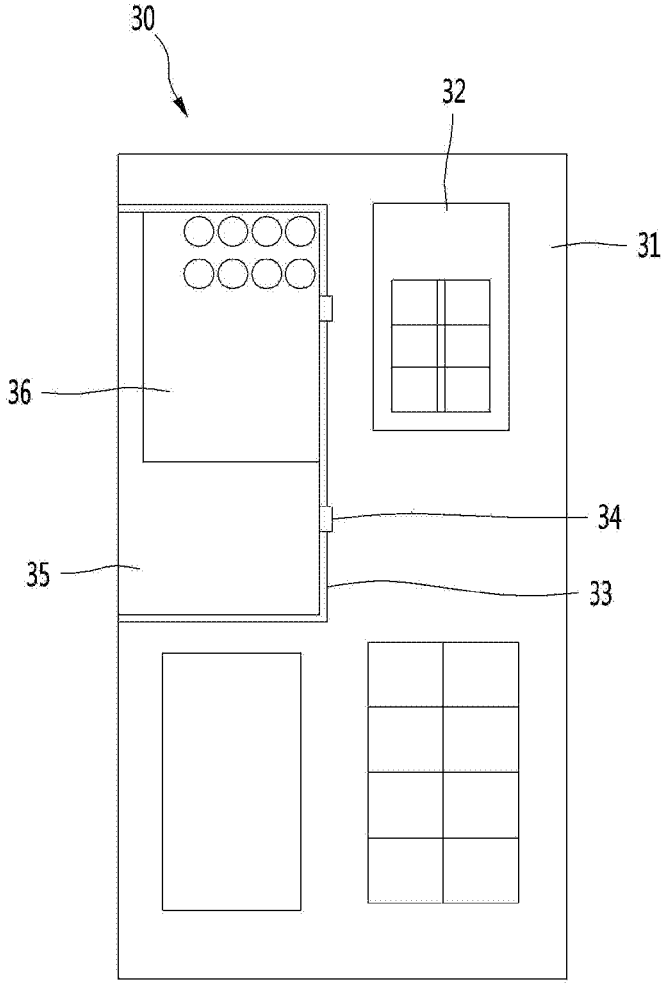
FIG. 6 is a front view illustrating a control box of the outdoor unit of the air conditioner according to an embodiment.
Figure 7:
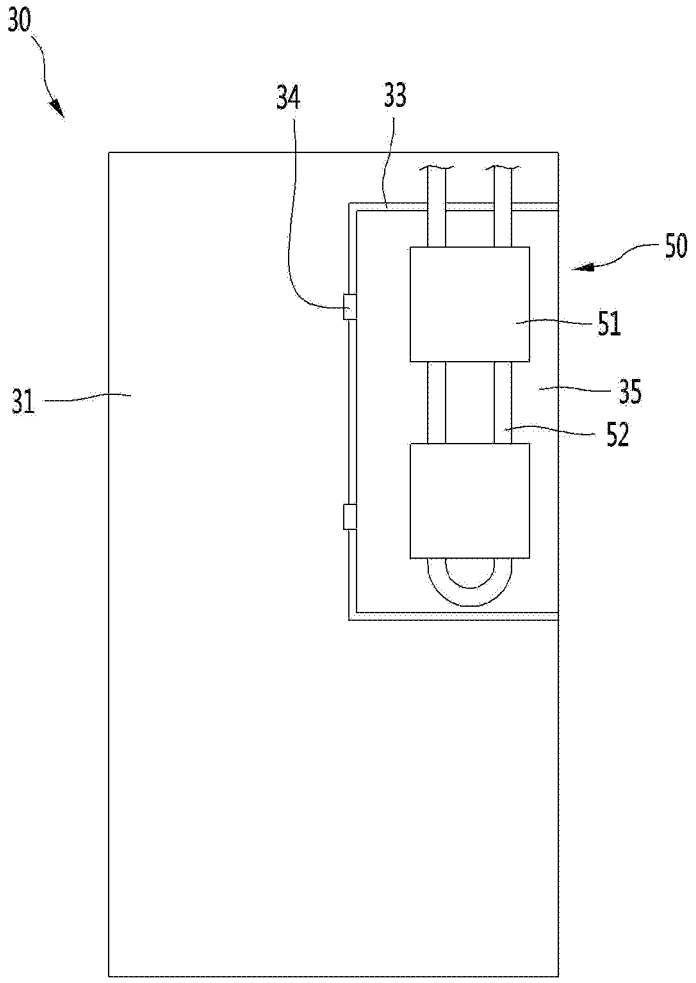
FIG. 7 is a rear view illustrating the control box of the outdoor unit of the air conditioner according to an embodiment.

FIG. 6 is a front view illustrating the control box of the outdoor unit of the air conditioner according to an embodiment. FIG. 7 is a rear view illustrating the control box of the outdoor unit of the air conditioner according to an embodiment. FIGS. 6 and 7 illustrate the first arrangement of the control unit 30, that is, the case in which the first control unit part 31 is provided at the first position.

As illustrated in FIGS. 6 and 7, when the first control unit part 31 is disposed at the first position, the first control unit part 31 and the second control unit part 35 are disposed to contact each other. The control unit 30 includes a unit connection part 34 that separably connects the first control unit part 31 to the second control unit part 35. The unit connection part 34 may be understood as a component configured so that the first control unit part 31 and the second control unit part 35 are stably disposed in the case 10.

The second control unit part 35 is relatively unstably fixed because the second control unit part 35 is installed inside of the case 10 by the cooling unit 50. Thus, as the second control unit part 35 is coupled to the first control unit part 31 stably fixed to the case 10 by the coupling member 40, the second control unit part 35 may be stably fixed.

The first control unit part 31 may rotate by shaking, or movement, for example, of the case 10. Thus, as the first control unit part 31 is coupled to the second control unit part 35 fixed and disposed on the case 10, the first control unit part 31 may be stably fixed.

The unit connection part 34 may be provided in various forms, such as a hook structure, that is separably connected. For example, the unit connection part 34 may be provided with a structure that is fixed to the first control unit part 31 and coupled to one side of the second control unit 35 by external force.

Also, the control unit 30 includes a sealing member 33 disposed between the first control unit part 31 and the second control unit part 35. The sealing member 33 is provided along an outer surface of the second control unit 35 to prevent moisture from being permeated into the control unit 30.

Referring to FIG. 7, the cooling unit 50 may be disposed on a rear surface of the second control unit part 35. The cooling unit 50 includes a heat dissipation member 51 and cooling pipe 52.

The heat dissipation member 51 may be understood as a member that promotes heat exchange between the second control unit part 35 and the cooling pipe 52. For example, the heat dissipation member 51 may be made of aluminum, for example, having good heat transfer performance. Also, a plurality of the heat dissipation member 51 may be provided and fixed to the second control unit part 35.

The cooling pipe 52 may contact the heat dissipation member 51 so as to perform heat-exchange with the second control unit part 35. For example, the cooling pipe 52 may be installed by being inserted into the heat radiating member 51.

A refrigerant having a temperature lower than that of the second control unit part 35 may flow through the cooling pipe 52. For example, the refrigerant discharged from the compressor 21 may flow in the cooling pipe 52. That is, the cooling pipe 52 may correspond to a pipe branched from the refrigerant pipe through which the refrigerant discharged from the compressor 21 flows.

The invention claimed is:

1. An outdoor unit of an air conditioner, comprising:

a case;

a controller disposed in the case;

a coupling member configured to connect the case to the controller; and a cooling pipe coupled to a first side of the controller so as to perform heat-exchange with the controller, wherein the controller comprises:

a first controller connected to the coupling member so as to be rotatably coupled to the case; and a second controller coupled to the cooling pipe so as to be fixedly installed inside of the case, wherein the controller comprises a sealing member disposed between the first controller and the second controller when the first controller is disposed at a first position.

2. The outdoor unit according to claim 1, wherein the coupling member comprises at least one hinge installed in the case so that the first controller moves to the first position disposed inside of the case or a second position disposed outside of the case.

3. The outdoor unit according to claim 1, wherein the controller further comprises:

at least one first control member installed in the first controller; and at least one second control member installed in the second controller, wherein an amount of heat generation of the second control member is greater than an amount of heat generation of the first control member.

4. The outdoor unit according to claim 3, wherein the second control member comprises an inverter printed circuit board (PCB).

5. The outdoor unit according to claim 1, wherein the case comprises a service panel configured to define an outer appearance of the case, and wherein the second controller is disposed behind the service panel.

6. The outdoor unit according to claim 5, wherein the case further comprises:

a side panel configured to define an outer appearance of a side surface of the case; and a side supporter configured to connect the service panel to the side panel so as to define an outer appearance of an edge of the case, wherein the coupling member is configured to connect the side supporter to the first controller.

7. The outdoor unit according to claim 6, wherein the coupling member comprises a first hinge disposed above the second controller and a second hinge disposed below the second controller.

8. The outdoor unit according to claim 7, wherein the first hinge and the second hinge are configured to connect the first controller to the side supporter so that the first controller rotates about the side supporter.

9. The outdoor unit according to claim 6, wherein the second controller is disposed inside of the case to contact a first side of the side supporter.

10. The outdoor unit according to claim 9, wherein the first controller is connected to the side supporter by the coupling member to surround the second controller.

11. The outdoor unit according to claim 1, wherein the controller comprises a unit connector configured to separably connect the first controller to the second controller.

12. The outdoor unit according to claim 11, wherein the first controller is disposed at the first position disposed inside of the case or a second position disposed outside of the case.

13. The outdoor unit according to claim 12, wherein, when the first controller is disposed at the first position, the first controller and the second controller are coupled to each other by the unit connector.

14. The outdoor unit according to claim 1, wherein when the first controller is disposed at the first position, the first controller and the second controller contact each other.

* * * * *